US006244725B1

(12) United States Patent
Gary et al.

(10) Patent No.: US 6,244,725 B1
(45) Date of Patent: Jun. 12, 2001

(54) DECORATIVE LIGHTING DISPLAY SYSTEM

(75) Inventors: Lonnie F. Gary, Ransom Canyon; Stephen L. Fillipp; Andrew G. Avinger, both of Lubbock, all of TX (US)

(73) Assignee: Gary Products Group, Inc., Lubbock, TX (US)

( * ) Notice: Subject to any disclaimer, the term of this patent is extended or adjusted under 35 U.S.C. 154(b) by 0 days.

(21) Appl. No.: 09/499,779

(22) Filed: Feb. 8, 2000

(51) Int. Cl.[7] ..... F21V 33/00

(52) U.S. Cl. ..... 362/234; 362/86; 362/806

(58) Field of Search ..... 362/105, 86, 806, 362/249, 234

(56) References Cited

U.S. PATENT DOCUMENTS

| | | | | |
|---|---|---|---|---|
| 4,683,588 | * | 7/1987 | Goldberg | 381/61 |
| 4,690,653 | * | 9/1987 | Goldberg | 446/27 |
| 5,953,145 | * | 9/1999 | Koyama | 359/152 |
| 6,048,209 | * | 4/2000 | Bailey | 434/267 |

* cited by examiner

*Primary Examiner*—Sandra O'Shea
*Assistant Examiner*—Hargobind S. Sawhney
(74) *Attorney, Agent, or Firm*—Locke Liddell & Sapp LLP

(57) ABSTRACT

A decorative lighting display unit includes a housing having a shape of an eye mask including areas simulating a pair of eye balls. An illumination source is disposed within the housing for illuminating the areas simulating the pair of eye balls. A controller is utilized for energizing the display unit which may control multiple units for creating an on\off lighting pattern.

8 Claims, 3 Drawing Sheets

DECORATIVE LIGHTING DISPLAY SYSTEM

TECHNICAL FIELD OF THE INVENTION

The present invention relates to lighting display systems, and more particularly to a Halloween eye mask lighting display unit and system.

BACKGROUND OF THE INVENTION

Seasonal lighting display systems are utilized to decorate homes, typically at Christmastime, to create a pleasing and festive environment for the season. Ghosts, goblins, and trick or treaters are typically associated with Halloween, and home owners also desire to decorate their houses using lighting displays to celebrate the season. A need has thus arisen for a unique decorative lighting system for Halloween.

SUMMARY OF THE INVENTION

In accordance with the present invention, a decorative lighting display unit is provided. The unit includes a housing having a shape of an eye mask including areas simulating a pair of eye balls. An illumination source is disposed within the housing for illuminating the areas simulating the pair of eye balls. A controller is utilized for energizing the display unit which may control multiple units for creating an on\off lighting pattern.

BRIEF DESCRIPTION OF THE DRAWINGS

For a more complete understanding of the present invention and for further advantages thereof, reference is now made to the following Description of the Preferred Embodiments taken in conjunction with the accompanying Drawings in which.

DESCRIPTION OF THE PREFERRED EMBODIMENTS

Figure 1:
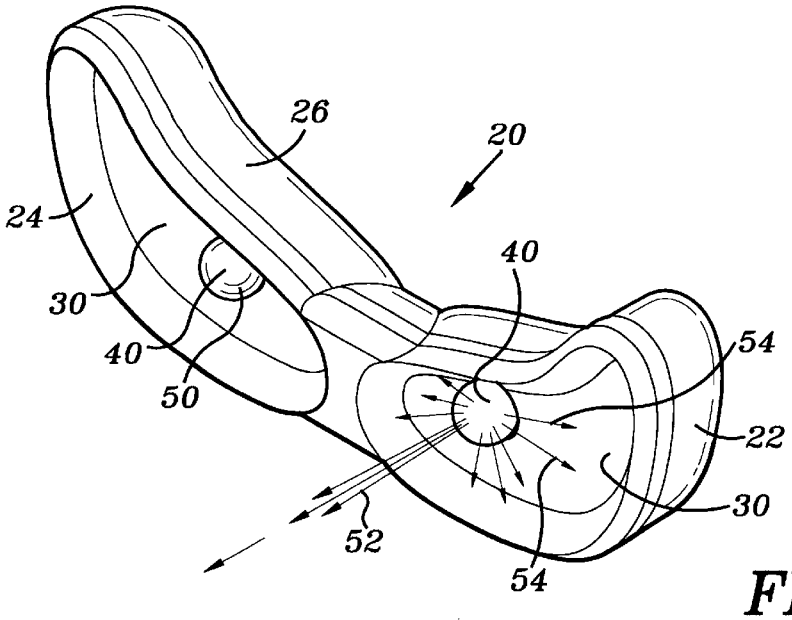
FIG. 1 is a perspective view of the present lighting display unit.
Figure 2:
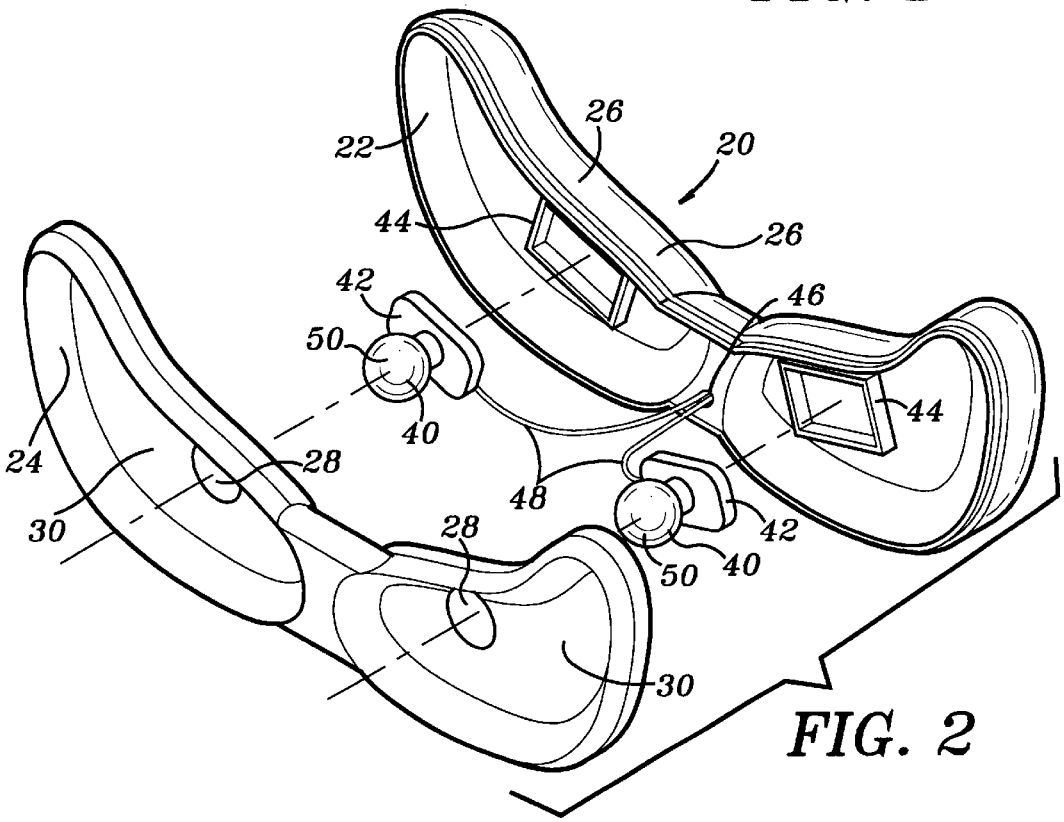
FIG. 2 is an exploded perspective view of the present lighting display unit shown in FIG. 1.

Referring simultaneously to FIGS. 1 and 2, the present decorative lighting display unit is illustrated, and is generally identified by the numeral 20. Unit 20 has a shape of an eye mask to simulate the appearance of a pair of eyes of a human or animal. Unit 20 includes a housing 22 having a front portion 24 and rear portion 26. Front portion 24 of housing 22 includes eye apertures 28, simulating the position of eyes covered by a mask in the form of front portion 24. Surrounding eye apertures 28 are concave reflective surfaces 30.

Disposed within housing 22 are light sources, such as, for example, light emitting diodes 40 which are aligned with eye apertures 28, and mounted to rear portion 26 of housing 22. Light emitting diodes 40 are interconnected to a printed circuit board 42 which includes related circuitry for driving light emitting diodes 40, as is well known to those skilled in the art. Printed circuit boards 42 are mounted within a frame 44 within rear portion 26 of housing 22. Rear portion 26 also includes an aperture 46 through which light emitting diode electrical leads 48 pass. Leads 48 are connected to a controller to be subsequently described with respect to FIG. 5. Light emitting diodes 40 include a spherical lens 50 which protrudes through eye apertures 28. Lens 50 creates an illumination source which is concentrated in the area of eye apertures 28 and which radiates outwardly into area 30 of front portion 24 of housing 22 to further illuminate unit 20 and create the appearance of eyes.

Figure 3:
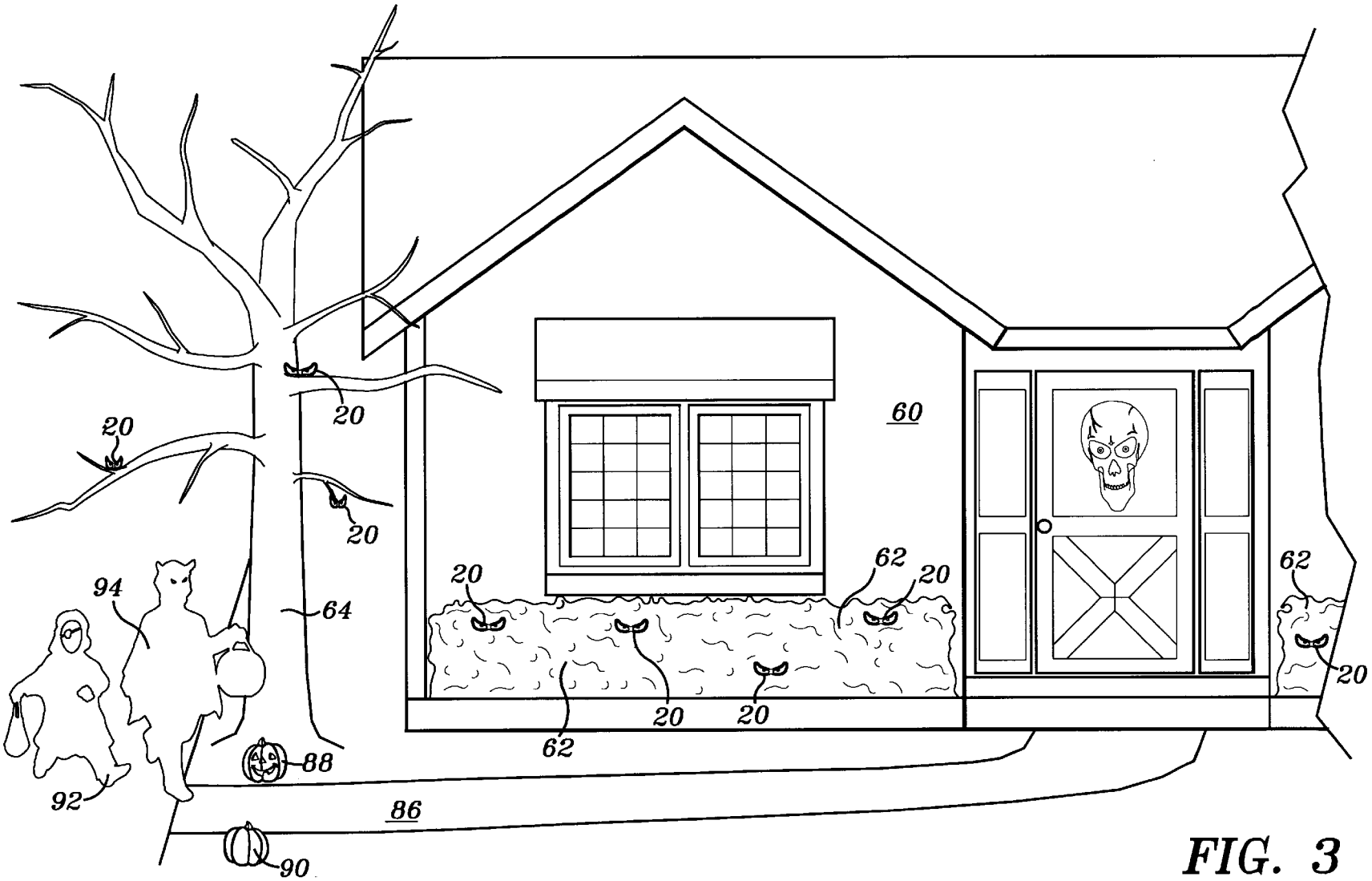
FIG. 3 is a pictorial scene showing use of the present lighting display system.

Referring to FIG. 3, a house 60 decorated for the Halloween season is illustrated. Decorations include multiple units 20 which are attached to shrubbery 62 and a tree 64. Units 20 are electrically connected in series to be continuously illuminated, periodically illuminates, or illuminated in a predetermined on/off lighting sequence to create the present lighting display system.

Figure 4:
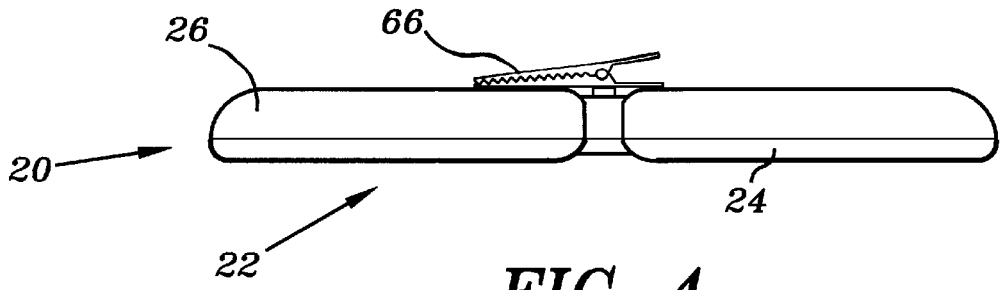
FIG. 4 is a top plan view of the present lighting display unit shown in FIG. 1, illustrating a fastener.

Units 20 may be attached to shrubbery 62 and tree 64 utilizing a clip 66, as illustrated in FIG. 4. Clip 66 is attached to rear portion 26 of housing 22 and provides for numerous mounting positions.

Figure 5:
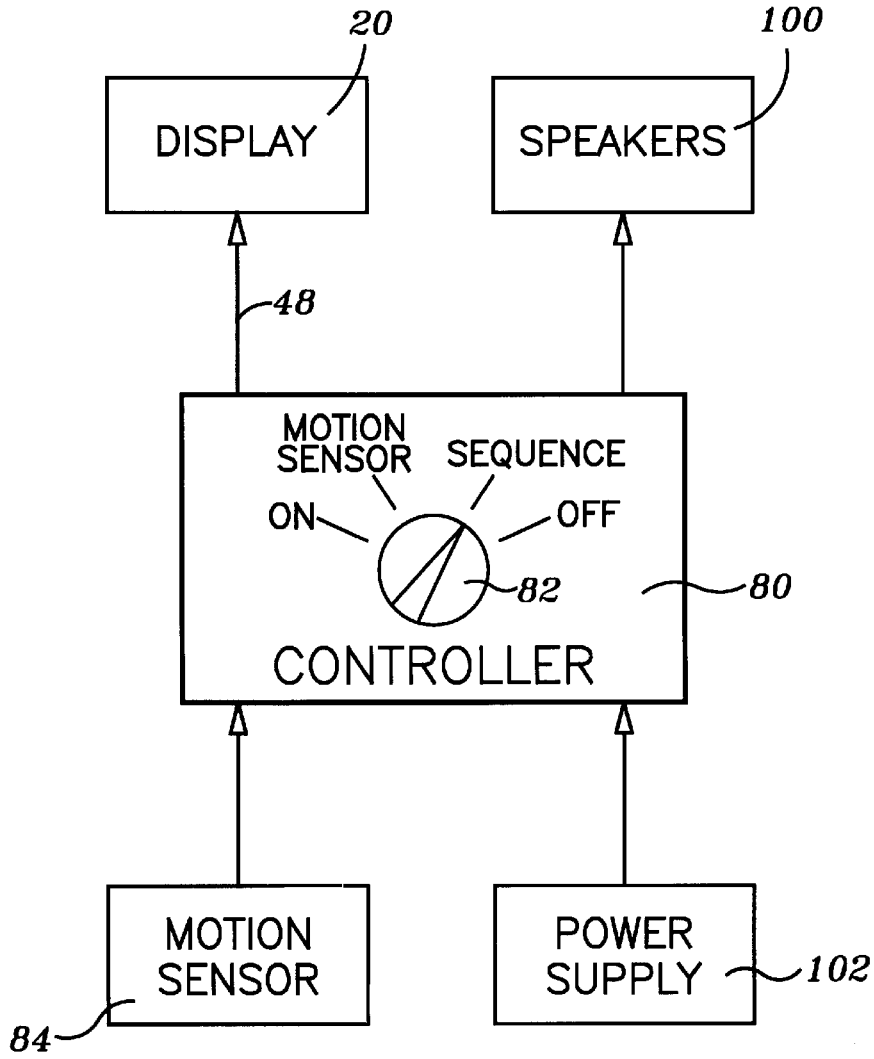
FIG. 5 is a schematic block diagram of the present control system for the present lighting display system.

Referring simultaneously to FIGS. 3 and 5, units 20 are controlled by a controller unit 80. Controller unit 80 may comprise, for example, an integrated circuit Model No. SPC41A1 manufactured and sold by Sunplus Technology Co., Ltd. Controller 80 includes a timer and counter for sequencing the on/off lighting cycle of each unit 20 in a predetermined lighting pattern. Additionally, controller 80 can turn all units 20 on in a continuous manner. Controller 80 includes a selector switch 82 for selecting an off mode, sequence mode, motion sensor mode, and continuous on mode. In the motion sensor mode of controller 80, a motion sensor 84 provides an output signal to controller 80 to illuminate units 20. Motion sensor 84 includes a sensor and detector such as, for example, an infrared motion sensor which be positioned along sidewalk 86 leading to house 60. Motion sensor 84 includes a signal generator and detector which may be housed within simulated pumpkins 88 and 90, respectively. The unsuspecting trick or treaters 92 and 94 walking along sidewalk 86, and adjacent to pumpkin 88 will actuate motion sensor 84 with controller 82 in the motion sensor mode of operation to actuate units 20, and surprise the trick or treaters 92 and 94 with the illumination of eyes coming from shrubbery 62 and tree 64.

Controller 80 may also include a read only memory and central processing unit for speech and melody synthesis. Users of the present system can record or synthesize sound and digitize such sound into the read only memory of controller 80. The sound can be played in sequence with the illumination of units 20 through speakers 100 which may be located adjacent to display units 20 in shrubbery 62 or inside house 60. Sounds such as screams, chewing and crunching, and burps may emanate from speakers 100 to additionally surprise trick or treaters 92 and 94. Controller 80 is powered by a power supply 102 which may also be integral to controller 80 and comprise battery or on-line power.

It therefore can be seen that the present invention provides for a decorative lighting display system for use in Halloween displays including the illumination of simulated eyes.

Whereas the present invention has been described with respect to specific embodiments thereof, it will be understood that various changes and modifications will be suggested to one skilled in the art and it is intended to encompass such changes and modifications as fall within the scope of the appended claims.

What is claimed is:

1. A decorative lighting display system comprising:

a plurality of lighting display units, each unit including a housing having a shape of an eye mask and including areas simulating a pair of eyeballs;

each of said plurality of lighting display units further including an illumination source disposed within said housing for illuminating said areas; and means for sequentially illuminating said plurality of lighting units in an on/off lighting pattern.

2. The lighting display system of claim 1 wherein said illumination source comprises first and second light emitting diodes.

3. The lighting display system of claim 1 and further including;

a motion sensor wherein said means for sequentially illuminating said plurality of lighting units is energized in response to actuation of said motion sensor.

4. The lighting display system of claim 1 and further including means for generating sounds when said illumination source is energized.

5. A decorative lighting display system comprising:

a plurality of lighting display units, each unit including a housing including areas simulating a pair of eyeballs;

each of said plurality of lighting display units further including an illumination source disposed within said housing for illuminating said areas; and means for sequentially illuminating said plurality of lighting units in an on/off lighting pattern.

6. The lighting display system of claim 5 wherein said illumination source comprises first and second light emitting diodes.

7. The lighting display system of claim 5 and further including;

a sensor wherein said means for sequentially illuminating said plurality of lighting units is energized in response to actuation of said sensor.

8. The lighting display system of claim 5 and further including means for generating sounds when said illumination source is energized.

* * * * *